US010323384B2

(12) United States Patent
Murugesan et al.

(10) Patent No.: US 10,323,384 B2
(45) Date of Patent: Jun. 18, 2019

(54) ACTIVE DAMPING RIDE CONTROL SYSTEM FOR ATTENUATING OSCILLATIONS IN A HYDRAULIC ACTUATOR OF A MACHINE

(71) Applicant: Caterpillar Inc., Peoria, IL (US)

(72) Inventors: Vickram Murugesan, Plainfield, IL (US); Hongliu Du, Naperville, IL (US); Lonnie James Devier, Channahon, IL (US); Frank Breier, Shorewood, IL (US); Mandi Henderson, Naperville, IL (US); Matthew James Beschorner, Plainfield, IL (US)

(73) Assignee: Caterpillar Inc., Deerfield, IL (US)

( * ) Notice: Subject to any disclaimer, the term of this patent is extended or adjusted under 35 U.S.C. 154(b) by 188 days.

(21) Appl. No.: 15/373,074

(22) Filed: Dec. 8, 2016

(65) Prior Publication Data

US 2018/0163373 A1 Jun. 14, 2018

(51) Int. Cl.

| | |
|---|---|
| ***E02F 3/28*** | (2006.01) |
| ***E02F 9/08*** | (2006.01) |
| ***E02F 9/22*** | (2006.01) |
| ***F15B 1/26*** | (2006.01) |
| ***F15B 11/08*** | (2006.01) |
| ***F15B 13/04*** | (2006.01) |

(52) U.S. Cl.

CPC ..... *E02F 9/2207* (2013.01); *E02F 9/2228* (2013.01); *F15B 1/26* (2013.01); *F15B 11/08* (2013.01); *F15B 13/0401* (2013.01); *E02F 3/283* (2013.01); *E02F 9/0883* (2013.01); *E02F 9/2296* (2013.01); *F15B 2211/20546* (2013.01); *F15B 2211/7051* (2013.01)

(58) Field of Classification Search

None

See application file for complete search history.

(56) References Cited

U.S. PATENT DOCUMENTS

| | | | | |
|---|---|---|---|---|
| 5,807,080 A * | 9/1998 | Ochiai | F04B 1/2021 | 417/269 |
| 5,960,695 A * | 10/1999 | Aardema | F15B 11/006 | 137/596.17 |
| 6,267,041 B1 | 7/2001 | Skiba et al. | | |
| 6,442,934 B1 * | 9/2002 | Okuda | F04B 49/002 | 60/451 |

(Continued)

*Primary Examiner* — Jean Paul Cass

(74) *Attorney, Agent, or Firm* — William R. Tinker; Oblon, McClelland, Maier & Neustadt

(57) ABSTRACT

A ride control system includes four independent metering valves (IMVs) that are independently and selectively controlled by a controller for attenuating oscillations in a hydraulic actuator of a machine. The controller is configured to open at least one of the IMVs for supplying pressurized fluid from a tank to a head end chamber of the hydraulic actuator when a pressure of the head end chamber drops to a value less than an initially registered pressure. Additionally, when the displacement of the piston block is positive and the pressure in the head end chamber falls to a value less than the pressure of fluid in a rod end chamber of the hydraulic actuator, the controller may also open another one of the IMVs by which fluid from the rod end chamber could be supplied to the head end chamber for supplementing pump flow and attenuating oscillations in the hydraulic actuator.

20 Claims, 5 Drawing Sheets

(56) References Cited

U.S. PATENT DOCUMENTS

| | | | | |
|---|---|---|---|---|
| 6,467,264 | B1 | 10/2002 | Stephenson et al. | |
| 6,655,136 | B2 | 12/2003 | Holt et al. | |
| 6,705,079 | B1 | 3/2004 | Tabor et al. | |
| 6,789,387 | B2 | 9/2004 | Brinkman | |
| 7,353,743 | B2 | 4/2008 | Bugel et al. | |
| 7,614,336 | B2 | 11/2009 | Verkuilen et al. | |
| 7,661,937 | B2 * | 2/2010 | Beck | F04B 1/2021 417/269 |
| 8,047,120 | B2 * | 11/2011 | Shinohara | F04B 1/2042 417/269 |
| 8,096,227 | B2 | 1/2012 | Brickner | |
| 8,857,168 | B2 | 10/2014 | Opdenbosch | |
| 9,097,113 | B2 * | 8/2015 | Miyata | F04B 1/24 |
| 9,206,583 | B2 | 12/2015 | Beschorner et al. | |
| 9,261,118 | B2 | 2/2016 | Zhang et al. | |
| 9,341,170 | B2 * | 5/2016 | Krebs | F04B 1/2021 |
| 9,526,460 | B2 * | 12/2016 | Hashimshony | A61B 5/4312 |
| 9,976,573 | B2 * | 5/2018 | Martin | F04F 13/00 |
| 2010/0327011 | A1 * | 12/2010 | Rancourt | C06B 21/0008 86/20.15 |
| 2012/0037251 | A1 | 2/2012 | Ohmer | |
| 2015/0135801 | A1 * | 5/2015 | Davis | G01N 33/383 73/19.08 |
| 2016/0033352 | A1 * | 2/2016 | Adolfse | G01L 27/005 73/1.57 |
| 2018/0154728 | A1 * | 6/2018 | Giovanardi | B60G 17/04 |

* cited by examiner

ACTIVE DAMPING RIDE CONTROL SYSTEM FOR ATTENUATING OSCILLATIONS IN A HYDRAULIC ACTUATOR OF A MACHINE

TECHNICAL FIELD

The present disclosure relates to a hydraulic actuator of a machine. More particularly, the present disclosure relates to a ride control system and a method for attenuating oscillations in a hydraulic actuator of a machine.

BACKGROUND

Machines such as, but not limited to, wheel loaders are used to transport materials from one location to another. In a typical configuration of such a machine, a pair of hydraulic actuators may be provided for raising or lowering the boom relative to the frame of the wheel loader. Further, a bucket may be supported at the free end of the boom for hauling the materials. In some cases for example, when such a machine travels on an uneven ground surface, the ride quality of the wheel loader may be poor. In such cases, the poor ride quality of the machine may manifest itself as vibrations in the hydraulic actuators of the machine. It is hereby envisioned that due to the vibrations induced in the hydraulic actuators during operation, a stability of the machine itself may be negatively impacted and hence, the operator's comfort may be degraded significantly. Moreover the performance and service life of the hydraulic actuators may also deteriorate over time and use during such conditions of poor ride quality.

Many traditional designs of ride control systems are known in the art for attenuating vibrations induced in the hydraulic actuators. Most traditional designs of such previously known ride control systems typically involve the use of accumulators that are disposed in communication with a head end and/or a rod end of each hydraulic actuator. However, these accumulator may be expensive to install and operate.

Hence, there exists a need for an improved ride control system that is simple, cost-effective, and use of which also overcomes the aforementioned shortcomings.

SUMMARY OF THE DISCLOSURE

In one aspect, the present disclosure discloses a ride control system for operatively attenuating oscillations in a hydraulic actuator of a machine. The hydraulic actuator has a chamber and a piston block disposed within the chamber so as to define a head end chamber and a rod end chamber with mutually opposing faces of the piston block and the chamber. The ride control system is provided with a tank, and a variable displacement pump that is disposed downstream of the tank. The variable displacement pump is fluidly coupled to the tank via a primary supply line. Further, the variable displacement pump is also provided with a secondary supply line fluidly coupled downstream thereof.

The ride control system also includes a valve arrangement that is independently coupled to the tank, the variable displacement pump, and each of the head and rod end chambers of the hydraulic actuator. The valve arrangement is configured to operably attenuate oscillations of the piston block in the hydraulic actuator based at least partially on a pressure of fluid in the head end chamber of the hydraulic actuator and a displacement of the piston block in the hydraulic actuator.

In an embodiment, the valve arrangement includes four independent metering valves (IMVs) that can be disposed in the circuit to fluidly couple the hydraulic actuator to the variable displacement pump and the tank. In this embodiment, a first drain line fluidly couples the primary supply line with the head end chamber of the hydraulic actuator. The first drain line has a first independent metering valve (IMV) disposed therein. The first IMV is configured to operatively allow fluid to return from the head end chamber to the tank. The ride control system also includes a first supply line that fluidly couples the secondary supply line with the head end chamber of the hydraulic actuator. The first supply line has a second IMV disposed therein. The second IMV is configured to operatively supply fluid from the pump to the head end chamber of the hydraulic actuator.

Although four single IMVs are disclosed herein, in alternative embodiments, it can be contemplated to embody the valve arrangement using a pair of programmable split spool valves or a single spool valve in place of the four IMVs with suitable modifications, if required, in the hardware configurations of the given spool valve/s.

Also, it has been hereby contemplated to provide a first pressure sensor for measuring a pressure of fluid in the head end chamber of the hydraulic actuator. A displacement sensor is also provided for measuring a displacement of the piston block disposed in the hydraulic actuator. Alternatively, it can also be contemplated to implement other devices including, but not limited to, a linkage angle sensor to measure the linkage position and/or the cylinder displacement of the hydraulic actuator. The ride control system also includes a controller that is disposed in communication with each of the first pressure sensor, the displacement sensor, the first IMV, and the second IMV. Once the active ride control system is activated, the initial pressure of fluid in the head end chamber is measured by the first pressure sensor and is registered in the controller. When the head end pressure decreases below the registered pressure and if the deviation in the head end pressure is within a predetermined frequency range, the controller is configured to close the first IMV and open the second IMV so as to supply pressurized fluid from the pump into the head end chamber of the hydraulic actuator.

In an additional aspect of this disclosure, the controller is further configured to maintain the closed and open states of respective ones of the first IMV and the second IMV until the deviation in the pressure of fluid in the head end chamber is zero and the oscillations of the piston block in the hydraulic actuator is attenuated.

Additionally, a second supply line is also provided to fluidly couple the secondary supply line with the rod end chamber of the hydraulic actuator. The second supply line has a third IMV disposed therein. The third IMV is configured to operatively supply fluid from the pump to the rod end chamber of the hydraulic actuator. The ride control system also includes a second drain line that is configured to fluidly couple the primary supply line with the rod end chamber of the hydraulic actuator. The second drain line has a fourth IMV disposed therein. The fourth IMV is configured to operatively allow fluid to return from the rod end chamber to the tank.

Additionally, the ride control system also includes a second pressure sensor configured to measure a pressure of fluid in the rod end chamber of the hydraulic actuator, the second pressure sensor being disposed in communication with the controller. In an additional aspect of this disclosure, when the displacement of the piston block within the hydraulic actuator, as measured by the displacement sensor, is indicative of a positive displacement corresponding to an expansion of the hydraulic actuator, and if the pressure of fluid in the head end chamber as measured by the first pressure sensor is less than a pressure of fluid in the rod end chamber as measured by the second pressure sensor, then the controller is configured to open the second IMV and the third IMV so as to route fluid from the rod end chamber to the head end chamber.

Additionally, in a further aspect of this disclosure, the controller is further configured to close the third IMV when the pressure of fluid in the head end chamber is equal to or greater than the pressure of fluid in the rod end chamber. Also, the controller is further configured to close the fourth IMV when the third IMV is opened so as to prevent a flow of fluid from the rod end chamber of the hydraulic actuator to the tank via the second drain line.

In another aspect, embodiments of this disclosure have also been directed to a machine employing the ride control system of the present disclosure. Further, embodiments of this disclosure have also been directed to a method for attenuating oscillations in a hydraulic actuator of a machine.

Other features and aspects of this disclosure will be apparent from the following description and the accompanying drawings.

DETAILED DESCRIPTION

Reference will now be made in detail to specific aspects or features, examples of which are illustrated in the accompanying drawings. Wherever possible, corresponding or similar reference numbers will be used throughout the drawings to refer to the same or corresponding parts.

Figure 1:
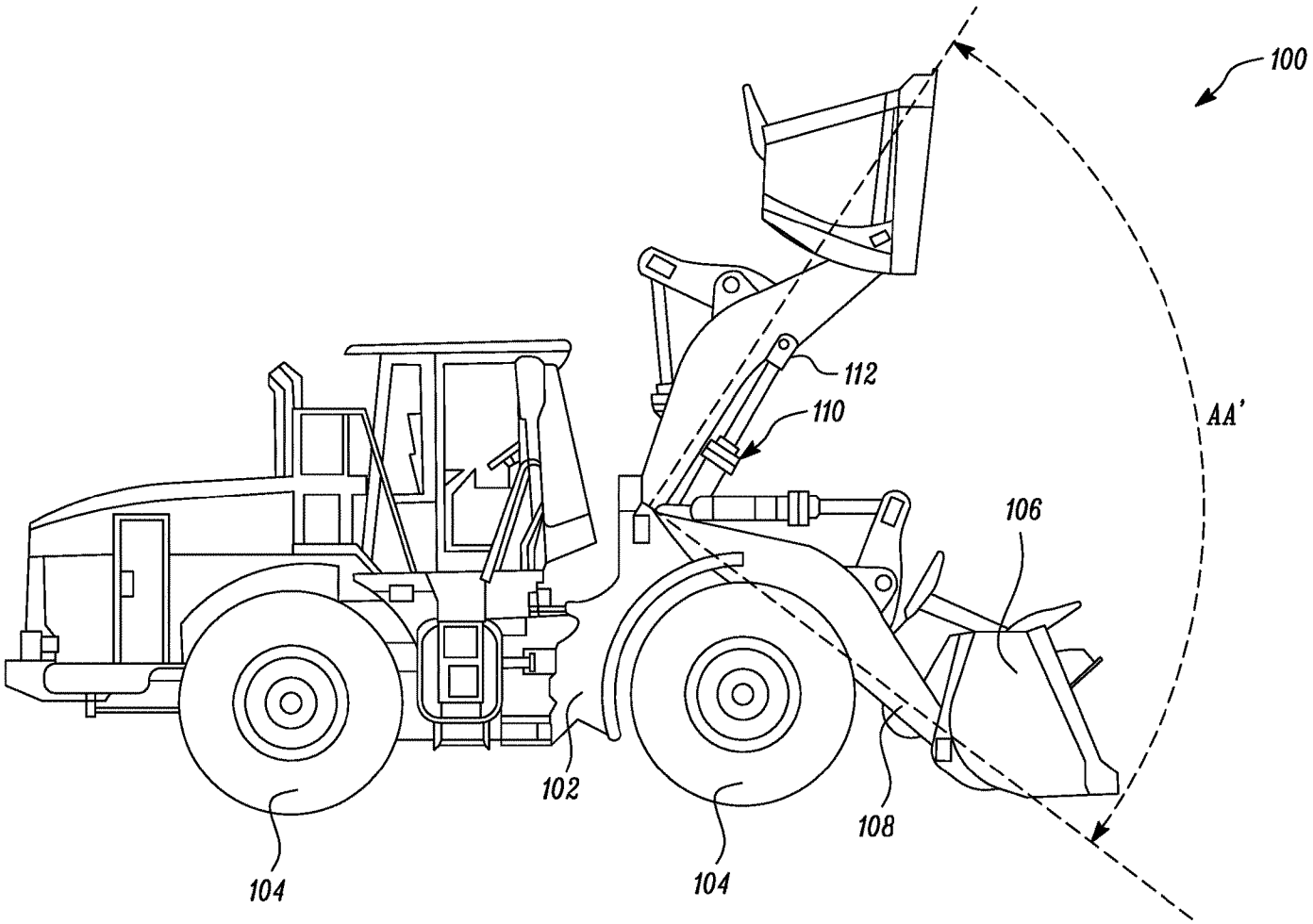
FIG. 1 is a side view of a machine showing a pair of hydraulic actuators for operatively facilitating movement of a work implement, according to an exemplary embodiment of the current disclosure.

FIG. 1 illustrates a side view of a machine 100, according to an exemplary embodiment of the present disclosure. In the illustrated embodiment, the machine 100 is embodied as a wheel loader. The machine 100 may be a fixed or a mobile machine that is configured to perform one or more than one type of operation associated with an industry such as mining, construction, farming, transportation, or any other industry known in the art. For example, in alternative embodiments, the machine 100 may include an excavator, a dozer, a harvester, a backhoe or other types of machines known in the art.

The machine 100 includes a frame 102. The frame 102 rotatably supports a set of ground engaging members 104 each of which is embodied as a wheel in the illustrated embodiment of FIG. 1. The ground engaging members 104 are configured to rotate about their respective axes thereby propelling the machine 100 on a ground surface. Alternatively, it can be contemplated to embody the set of ground engaging members 104 in the form of tracks (not shown) such that the tracks are configured to propel the machine 100.

The machine 100 further includes a work implement 106 configured to perform various tasks at a worksite. The work implement 106 may be configured to engage, penetrate, or cut the surface of the worksite and/or move the earth to accomplish a predetermined task. The worksite may include, for example, a mine site, a landfill, a quarry, a construction site, or any other type of worksite. Moving the earth may be associated with altering the geography at the worksite and may form a part of a main job function, for example, a grading operation, a scraping operation, a leveling operation, a bulk material removal operation, or any other type of geography altering operation at the worksite.

In the illustrated embodiment, the work implement 106 is a bucket that is pivotally mounted to the frame 102 with the help of a linkage 108 e.g., a boom as shown in FIG. 1. The work implement 106 may be disposed on the frame 102 at a front end of the machine 100. In this embodiment, the work implement 106 may be configured to perform a scooping operation so as to dig material from a pile on the work site and thereafter hold the material therein for transportation of the held material from one location to another. Although a bucket is disclosed herein, it will be acknowledged that a type and configuration of the work implement 106 disclosed herein may vary from one application to another depending on specific requirements of an application. Therefore, it may be noted that the type of work implement 106 disclosed herein is non-limiting of this disclosure. Other types of work implements may be implemented in place of the bucket depending on specific requirements of an application.

The machine 100 further includes a hydraulic actuator 110 pivotally coupled to the frame 102. One end 112 of the hydraulic actuator 110 may be coupled to the linkage 108 for lowering and raising the work implement 106 relative to the frame 102. As shown in the illustrated embodiment of FIG. 1, the work implement 106 has a pre-defined range of angular motion denoted by AA'.

It may be noted that other pre-defined ranges of motion may be possible depending on a type of machine used, a type of work implement used on the machine, and a configuration of linkages present on the machine for coupling the work implement to the frame of the machine. It is hereby envisioned that when a position of the work implement 106 is fixed relative to the frame 102 at a given point in its range of angular motion and the machine 100 experiences vibrations, for example, when travelling on an uneven ground surface, a weight of the work implement 106 and/or a payload of the work implement 106 may manifest itself as vibrations in the hydraulic actuator 110 of the machine 100.

Figure 2:
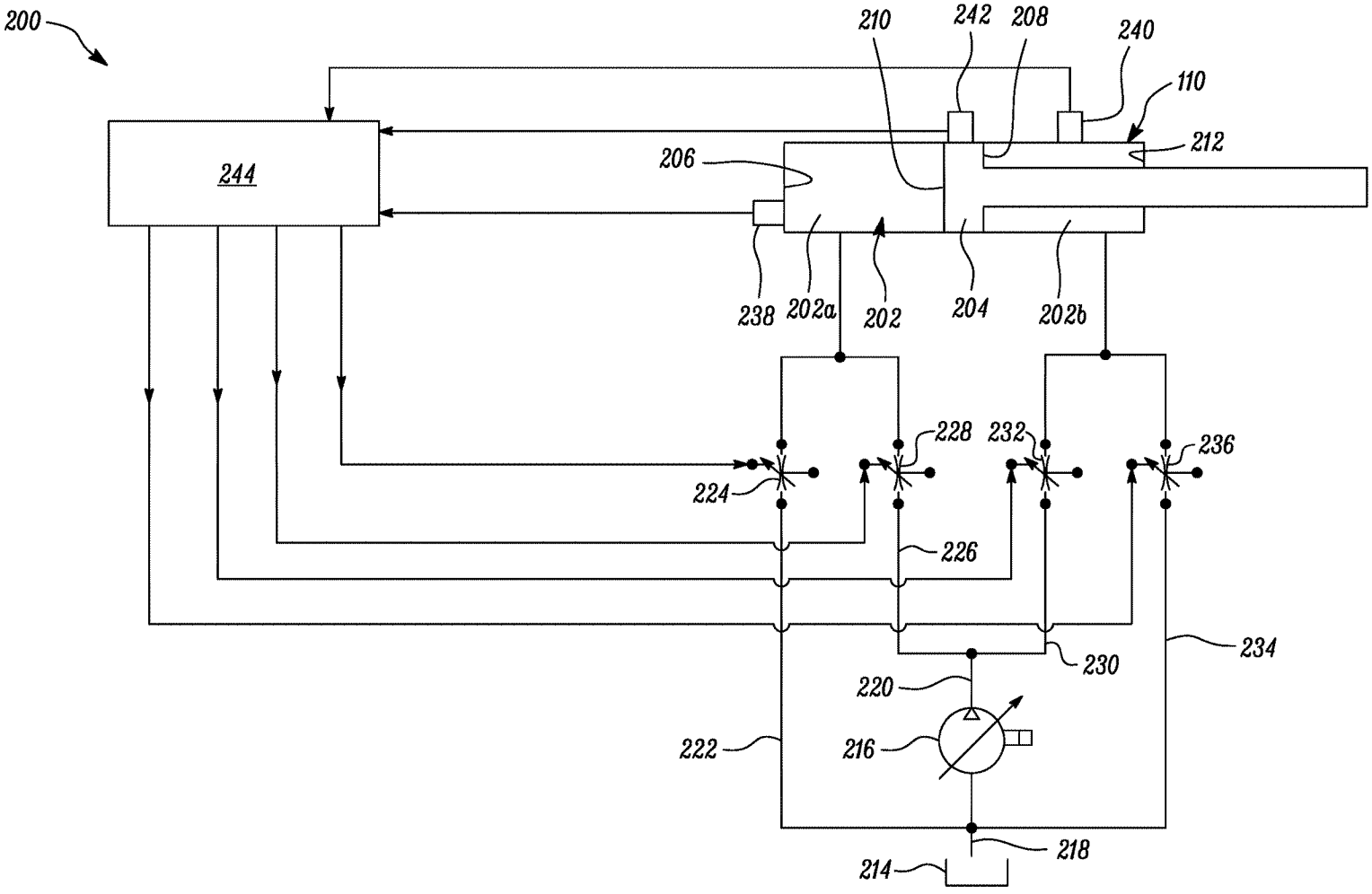
FIG. 2 is a schematic view of a control system, according to an embodiment of the current disclosure.

The present disclosure relates to a ride control system 200 that is configured to attenuate oscillations in the hydraulic actuator 110 of the machine 100. Referring to FIG. 2, a schematic of the ride control system 200 and the hydraulic actuator 110 is shown. The hydraulic actuator 110 has a chamber 202 and a piston block 204 disposed within the chamber 202 so as to define a head end chamber **202*a* and a rod end chamber 202*b* with respective ones of mutually opposing faces 206, 210 and 208, 212 of the piston block 204 and the chamber 202. As shown in FIG. 2, the ride control system 200 is provided with a tank 214, and a variable displacement pump 216 that is disposed downstream of the tank 214. The variable displacement pump 216 is fluidly coupled to the tank 214** via a primary supply line 218. Further, the variable displacement pump 216 is also provided with a secondary supply line 220 fluidly coupled downstream thereof.

The ride control system 200 includes a first drain line 222 that is configured to fluidly couple the primary supply line 218 with the head end chamber 202*a* of the hydraulic actuator 110. The first drain line 222 has a first independent metering valve (IMV) 224 disposed therein. The first IMV 224 is configured to operatively allow fluid to return from the head end chamber 202*a* to the tank 214. The ride control system 200 also includes a first supply line 226 that is configured to fluidly couple the secondary supply line 220 with the head end chamber 202*a* of the hydraulic actuator 110. The first supply line 226 has a second IMV 228 disposed therein, the second IMV 228 being configured to operatively supply fluid from the pump 216 to the head end chamber 202*a* of the hydraulic actuator 110.

Additionally, the ride control system 200 is further provided with a second supply line 230 that is configured to fluidly couple the secondary supply line 220 with the rod end chamber 202*b* of the hydraulic actuator 110. The second supply line 230 has a third IMV 232 disposed therein. The third IMV 232 is configured to operatively supply fluid from the pump 216 to the rod end chamber 202*b* of the hydraulic actuator 110. The ride control system 200 also includes a second drain line 234 that is configured to fluidly couple the primary supply line 218 with the rod end chamber 202*b* of the hydraulic actuator 110. The second drain line 234 has a fourth IMV 236 disposed therein. The fourth IMV 236 is configured to operatively allow fluid to return from the rod end chamber 202*b* to the tank 214.

The ride control system 200 further includes a first pressure sensor 238 configured to measure a pressure of fluid in the head end chamber 202*a* of the hydraulic actuator 110, and a second pressure sensor 240 configured to measure a pressure of fluid in the rod end chamber 202*b* of the hydraulic actuator 110. Additionally, the ride control system 200 also includes a displacement sensor 242 that is configured to measure a displacement of the piston block 204 disposed in the hydraulic actuator 110. The ride control system 200 also includes a controller 244 that is disposed in communication with each of the first pressure sensor 238, the displacement sensor 242, the first IMV 224, and the second IMV 228.

Once the ride control system 200 is activated, the initial pressure of fluid in the head end chamber 202*a* is measured by the first pressure sensor 238 and is registered in the controller 244. According to an embodiment of this disclosure, if the pressure of fluid in the head end chamber 202*a* as measured by the first pressure sensor 238 decreases to a value that is below the registered pressure and if the deviation in the head end pressure is within a predetermined frequency range, then the controller 244 is configured to close the first IMV 224 and open the second IMV 228 so as to supply pressurized fluid from the pump 216 into the head end chamber 202*a* of the hydraulic actuator 110. 216 into the head end chamber 202*a* of the hydraulic actuator 110.

In an example, if the initial pressure of fluid in the head end chamber is 1500 kPa and the pressure in the head end chamber 202*a* drops to 100 kPa in a duration of 5 seconds, then the controller 244 may not be configured to close the first IMV 224 and open the second IMV 228. However, in another example in accordance with the foregoing embodiment, if the initial pressure of fluid in the head end chamber 202*a* is 1500 kPa and the pressure in the head end chamber 202*a* drops from 1500 kPa to 100 kPa in a duration of 0.5 second, then the controller 244 may close the first IMV 224 and open the second IMV 228. The predetermined frequency range disclosed herein can be advantageously estimated and set to a value by the controller 244, for use and implementation in closing the first IMV 224 and opening the second IMV 228 for attenuating oscillations in the hydraulic actuator 110, based on a variety of factors including, but not limited to, the pressure in the head end chamber 202*a*, a displacement of the piston block 204 in the hydraulic actuator 110, a position and/or angle of the linkage 108 with respect to the frame 102 and the like.

In accordance with another embodiment, if the pressure of fluid in the head end chamber 202*a* as measured by the first pressure sensor 238 increases to a value that is above the registered pressure and if the deviation in the head end pressure is not within the predetermined frequency range, then the controller 244 is configured to open the first IMV 224 and close the second IMV 228 so as to drain fluid from the head end chamber 202*a* of the hydraulic actuator 110 to the tank 214.

Additionally, when the pressure in the head end chamber 202*a* drops to a value below the registered initial pressure, the controller 244 is also configured to maintain the closed and open states of respective ones of the first IMV 224 and the second IMV 228 until the oscillations in the pressure of fluid in the head end chamber 202*a* is attenuated.

In a further embodiment, when the displacement of the piston block 204 within the hydraulic actuator 110, as measured by the displacement sensor 242, is indicative of a positive displacement corresponding to an expansion of the hydraulic actuator 110, and if the pressure of fluid in the head end chamber 202*a* as measured by the first pressure sensor 238 is less than a pressure of fluid in the rod end chamber 202*b* as measured by the second pressure sensor 240, then the controller 244 is further configured to open the third IMV 232 so as to route fluid from the rod end chamber 202*b* to the head end chamber 202*a*. This way, fluid that is routed from the rod end chamber 202*b* to the head end chamber 202*a* increases a pressure of the head end chamber 202*a* so that a pressure difference between the head end chamber 202*a* and the rod end chamber 202*b* is minimized until it reaches a zero difference.

Thereafter, when the pressure of fluid in the head end chamber 202*a* becomes equal to or greater than the pressure of fluid in the rod end chamber 202*b*, the controller 244 is configured to close the third IMV 232. Further, when the third IMV 232 is opened, it is hereby contemplated that the controller 244 is also configured to close the fourth IMV 236 so as to prevent a flow of fluid from the rod end chamber 202*b* of the hydraulic actuator 110 to the tank 214 via the second drain line 234. This way, the flow from the pump to the head end chamber 202*a* 216 can be supplemented by the supply of fluid from the rod end chamber 202*b* to the head end chamber 202*a* and hence avoid a possibility of voiding occurring in the head end chamber 202*a* of the hydraulic actuator 110. This also helps to eliminate the possibility of cavitation from occurring in the head end chamber 202*a* and improves an overall service life of the hydraulic actuator 110. Additionally, the supplemental flow from the rod end chamber 202*b* to the head end chamber 202*a* helps in facilitating a decay of the oscillations more rapidly as compared to supplying fluid from the pump 216 alone, due to which, vibrations or oscillations of the piston block 204 in the hydraulic actuator 110 can be attenuated faster.

Figure 3:
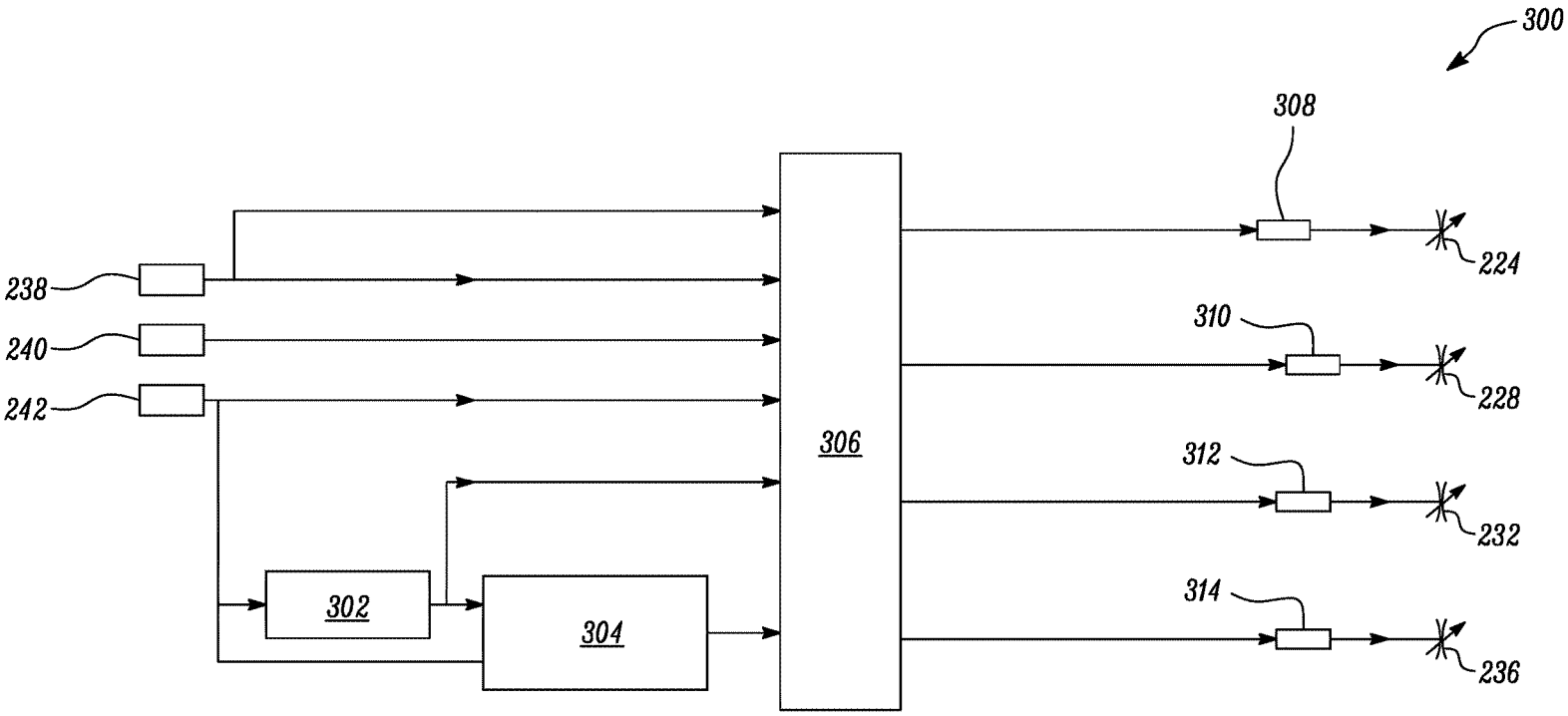
FIG. 3 is a low-level circuit diagram of the control system, according to an embodiment of the current disclosure.

FIG. 3 illustrates a low-level circuit diagram 300 of the ride control system 200 from FIG. 2, according to an embodiment of the current disclosure. It may be noted that the low-level circuit diagram 300 disclosed herein is non-limiting of this disclosure. Various other suitable hardware and software may, additionally or optionally, be implemented for use with the low-level circuit diagram 300 of the ride control system 200 shown in the illustrated embodiment of FIG. 3.

It should be noted that the controller 244 of the present disclosure may be a single microprocessor or multiple microprocessors that include components for performing functions that are consistent with the present disclosure. Numerous commercially available microprocessors can be configured to perform the functions of the controller 244 disclosed herein. It should be appreciated that the controller 244 could readily be embodied in a general purpose microprocessor capable of controlling numerous functions associated with the ride control system 200 of the machine 100. The controller 244 may also include a processor, a memory, a secondary storage device, and any other components for running an application. Various circuits may be associated with the controller 244 such as a power supply circuitry, a solenoid driver circuitry, a signal conditioning circuitry for e.g., an analog-to-digital converter circuitry, and other types of circuitry. Various routines, algorithms, and/or programs can be programmed within the controller 244 for execution thereof. Moreover, it should be noted that the controller 244 disclosed herein may be a stand-alone controller 244 or may be configured to co-operate with existing controller 244/s, for example, an electronic control module (ECM) (not shown) of the machine 100 to perform functions that are consistent with the present disclosure.

With reference to FIG. 3, the ride control system 200 may include a pre-processing module 302 that is configured to receive pressure and displacement signals from respective ones of the pressure and displacement sensors 238-242 disclosed earlier herein. The pre-processing module 302 may also be configured to convert the pressure and displacement signals into a suitable format for facilitating further computations by the controller 244 and for subsequently realizing functions consistent with the present disclosure.

The ride control system 200 also includes a disturbance rejection module 304 that is disposed in communication with the pre-processing module 302. The disturbance rejection module 304 is also disposed in communication with a command module 306 that is coupled with four electronically operable solenoids 308-314 in which one solenoid is provided for controlling a corresponding one of the first, second, third, and fourth IMVs 224, 228, 232, and 236 disclosed herein. The pre-processing module 302 may be configured to operatively determine, from output signals of the first and second pressure sensors 238, 240 and the displacement sensor 242, if oscillations are occurring in the pressure at the head end chamber 202*a* of the hydraulic actuator 110. If so, the disturbance rejection module 304 is configured to send appropriate signals to the command module 306 for modulating one or more command signals of the command module 306 before such command signals are output to one or more of the four solenoids 308-314 so that corresponding position/s of one or more of the four IMVs 224, 228, 232, and 236 is realized for attenuating any pressure oscillations within the hydraulic actuator 110.

Figure 4:
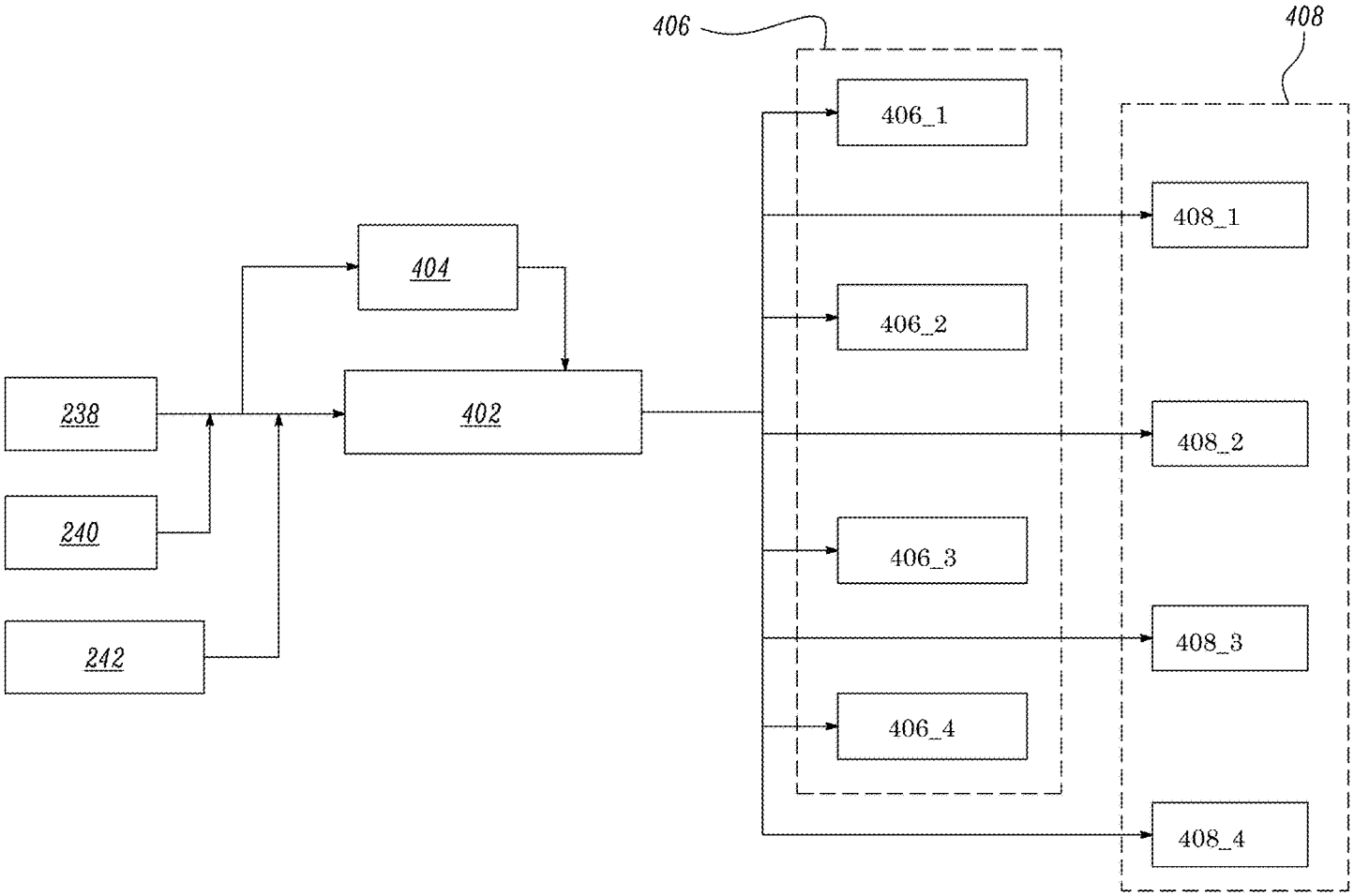
FIG. 4 illustrates an exemplary configuration of the low-level circuit diagram of the control system in accordance with an exemplary embodiment of the current disclosure.

FIG. 4 illustrates an exemplary configuration of the low-level circuit diagram 300 of the ride control system 200 in which the controller 244 is implemented, at least in part, with use of a non-linear proportional controller 402 that is associated with a band-pass filter 404. However, it should be noted that in alternative embodiments of this disclosure, other types of controllers including, but not limited to, an integral controller, a proportional-integral (PI) controller, or a non-linear proportional-integral-differential (PID) controller may be used in place of the proportional controller 402 disclosed herein.

Further, as shown in the illustrated embodiments of FIGS. 3 and 4, the command module 306 includes a first set of modules 406 for determining a current state of corresponding ones of the four IMVs and a second set of modules 408 for scheduling the current command to each of the four solenoids 308-314 (refer to FIG. 3). It should be noted that the first and second sets of modules 406 (e.g., 406 1-406 4), 408 (e.g., 408 1-408 4) disclosed herein may be implemented with the help of any device/s known to persons skilled in the art for forming the command module 306 of the present disclosure. Based on the inputs received at the controller 244, the controller 244 selectively and independently outputs appropriate command signals to the each of the four solenoids 308-314 for attenuating pressure oscillations in the hydraulic actuator 110.

INDUSTRIAL APPLICABILITY

Figure 5:
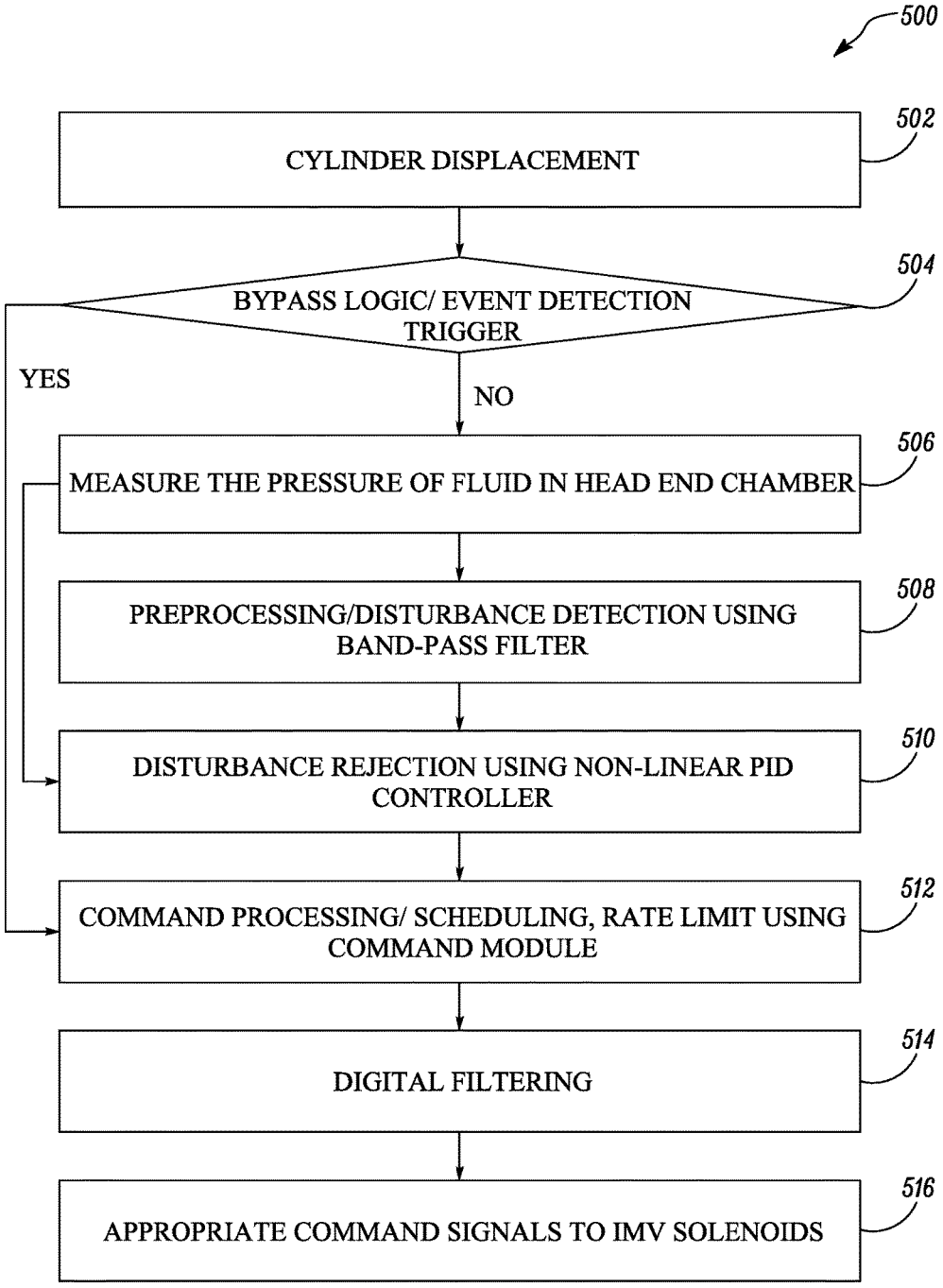
FIG. 5 is a flowchart of a method for attenuating oscillations in a hydraulic actuator, according to an embodiment of the current disclosure.

FIG. 5 depicts a flowchart showing a method 500 for operatively attenuating oscillations in the hydraulic actuator 110. At step 502, the method 500 includes measuring a displacement of the piston block 204 disposed in the hydraulic actuator 110. At step 504, the method 500 includes registering the event comprising movement of the linkage 108 relative to the frame 102 at the controller 244. A sub-routine of the method 500 comprises steps 506-516 explanation to which is made hereinafter.

At step 506, the method 500 includes measuring the pressure of fluid in the head end chamber 202*a* of the hydraulic actuator 110. At step 508, the method 500 further includes processing, with the help of the pre-processing module 302, the pressure signals into a suitable format for facilitating further computations by the controller 244. Also, the pre-processing module 302 may be configured to operatively determine, from output signals of the first and second pressure sensors 238, 240 and the displacement sensor 242, if oscillations are occurring in the pressure at the head end chamber 202*a* of the hydraulic actuator 110 at a certain pre-determined frequency. If so, then at steps 510-512, the method 500 further includes issuing, by the disturbance rejection module 304, appropriate signals to the command module 306 for modulating one or more command signals of the command module 306 before such command signals are output to one or more of the four solenoids 308-314 so that corresponding position/s of one or more of the four IMVs 224, 228, 232, and 236 is realized for attenuating any pressure oscillations within the hydraulic actuator 110.

Moreover, at step 514, a further sub-routine of the method 500 may also include filtering, with the help of one or more digital filters (not shown), the command signals being issued from the command module 306. Although one band-pass filter 404 is disclosed herein, it should be noted that other types of digital filters, including, but not limited to, a high-pass filter, a low-pass filter, or even other band-pass filters may be employed in addition to the band-pass filter 404 disclosed herein. The types of digital filter/s employed in the ride control system 200 may depend on various factors including, but not limited to, system specific hardware configuration associated with components of the ride control system 200, and any signal conditioning requirements to be met in order for the ride control system 200 to perform functions consistent with the present disclosure.

Upon filtering the command signals with the help of the digital filter/s, at step 516, the method 500 then includes sending the appropriate command signals to one or more of the four solenoids 308-314 (see FIG. 3) such that corresponding positions of the four IMVs 224, 228, 232, and 236 can be realized for accomplishing functions disclosed herein.

Embodiments of this disclosure have applicability for use and implementation in attenuating oscillations in hydraulic actuators of machines. With use of embodiments disclosed herein, manufacturers of machines can do away with use of accumulators and therefore, implement the present ride control system 200 in machines in a fairly inexpensive manner as compared to traditionally known designs of ride control systems.

Moreover, as embodiments of the present disclosure allow manufacturers to do away with use of accumulators, a reliability of hardware associated with the present ride control system 200 in operation is improved. Consequently, costs, time, and effort previously incurred with maintenance and replacement of accumulators from traditionally known designs of ride control systems can be advantageously mitigated with use of the present ride control system 200.

Further, as embodiments of the present disclosure disclose the use of independent metering valves (IMVs), each of which are quick to operate in response to input commands from the controller 244, an attenuation of oscillations in the hydraulic actuator 110 may be accomplished more quickly as compared with the use of traditionally known ride control systems that typically employ one or more accumulators therein.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A ride control system for operatively attenuating oscillations in a hydraulic actuator of a machine, the hydraulic actuator having a chamber and a piston block disposed within the chamber to define a head end chamber and a rod end chamber with mutually opposing faces of the piston block and the chamber, the ride control system comprising:

a tank;

a variable displacement pump disposed downstream of the tank and fluidly coupled to the tank via a primary supply line, the variable displacement pump being provided with a secondary supply line fluidly coupled downstream thereof;

a valve arrangement independently coupled to the tank, the variable displacement pump, and each of the head and rod end chambers of the hydraulic actuator, the valve arrangement configured to operably attenuate oscillations of the piston block in the hydraulic actuator based at least partially on a pressure of fluid in the head end chamber of the hydraulic actuator and a displacement of the piston block in the hydraulic actuator;

a first independent metering valve (IMV) configured to operatively allow fluid to return from the head end chamber to the tank;

a second IMV configured to operatively supply fluid from the variable displacement pump to the head end chamber of the hydraulic actuator;

a displacement sensor configured to measure a displacement of the piston block disposed in the hydraulic actuator; and a controller disposed in communication with each of a first pressure sensor configured to measure a pressure of fluid in the head end chamber of the hydraulic actuator, the displacement sensor, the first IMV, and the second IMV, wherein the controller is configured to:

determine that the displacement of the piston block within the hydraulic actuator, as measured by the displacement sensor, is indicative of a positive displacement corresponding to an expansion of the hydraulic actuator, determine that the pressure of fluid in the head end chamber as measured by the first pressure sensor decreases to a value less than an initially registered pressure of fluid in the head end chamber registered upon activation of the ride control system, determine that a deviation in the pressure of fluid in the head end chamber is within a pre-determined frequency range associated with a time period within which to attenuate oscillations in the hydraulic actuator, and responsive to the determining that the displacement of the piston block within the hydraulic actuator is indicative of the positive displacement corresponding to the expansion of the hydraulic actuator, the determining that the pressure of fluid in the head end chamber has decreased to the value less than the initially registered pressure, and the determining that the deviation in the pressure of fluid in the head end chamber is within the pre-determined frequency range, close the first IMV and open the second IMV so as to supply pressurized fluid from the variable displacement pump into the head end chamber of the hydraulic actuator.

2. The ride control system of claim 1, wherein the valve arrangement includes:

a first drain line configured to fluidly couple the primary supply line with the head end chamber of the hydraulic actuator, the first drain line having the first IMV disposed therein;

a first supply line configured to fluidly couple the secondary supply line with the head end chamber of the hydraulic actuator, the first supply line having the second IMV disposed therein;

the first pressure sensor; and the displacement sensor, wherein the time period within which to attenuate oscillations in the hydraulic actuator is 0.5 seconds or less.

3. The ride control system of claim 2, wherein the controller is configured to maintain the closed and open states of respective ones of the first IMV and the second IMV until the pressure of fluid in the head end chamber corresponds with the initially registered pressure of fluid in the head end chamber.

4. The ride control system of claim 2 further comprising:

a second supply line configured to fluidly couple the secondary supply line with the rod end chamber of the hydraulic actuator, the second supply line having a third IMV disposed therein, the third IMV configured to operatively supply fluid from the variable displacement pump to the rod end chamber of the hydraulic actuator; and a second drain line configured to fluidly couple the primary supply line with the rod end chamber of the hydraulic actuator, the second drain line having a fourth IMV disposed therein, the fourth IMV configured to operatively allow fluid to return from the rod end chamber to the tank.

5. The ride control system of claim 4 further comprising a second pressure sensor configured to measure a pressure of fluid in the rod end chamber of the hydraulic actuator, the second pressure sensor being disposed in communication with the controller.

6. The ride control system of claim 5, wherein:

when the displacement of the piston block within the hydraulic actuator, as measured by the displacement sensor, is indicative of a positive displacement corresponding to an expansion of the hydraulic actuator; and when the pressure of fluid in the head end chamber as measured by the first pressure sensor is less than a pressure of fluid in the rod end chamber as measured by the second pressure sensor, then the controller is configured to open the second IMV and the third IMV so as to route fluid from the rod end chamber to the head end chamber.

7. The ride control system of claim 6, wherein the controller is configured to close the third IMV when the pressure of fluid in the head end chamber becomes equal to or greater than the pressure of fluid in the rod end chamber.

8. The ride control system of claim 6, wherein the controller is configured to close the fourth IMV when the third IMV is opened so as to prevent a flow of fluid from the rod end chamber of the hydraulic actuator to the tank via the second drain line.

9. A machine configured to implement a ride control system, the machine having:

a frame;

a tank disposed on the frame;

a hydraulic actuator pivotally coupled to the frame, the hydraulic actuator having a chamber and a piston block disposed within the chamber to define a head end chamber and a rod end chamber with mutually opposing faces of the piston block and the chamber;

a variable displacement pump disposed downstream of the tank and fluidly coupled to the tank via a primary supply line, the variable displacement pump being provided with a secondary supply line fluidly coupled downstream thereof;

a first drain line configured to fluidly couple the primary supply line with the head end chamber of the hydraulic actuator, the first drain line having a first independent metering valve (IMV) disposed therein, the first IMV configured to operatively allow fluid to return from the head end chamber to the tank;

a first supply line configured to fluidly couple the secondary supply line with the head end chamber of the hydraulic actuator, the first supply line having a second IMV disposed therein, the second IMV configured to operatively supply fluid from the variable displacement pump to the head end chamber of the hydraulic actuator;

a first pressure sensor configured to measure a pressure of fluid in the head end chamber of the hydraulic actuator;

a displacement sensor configured to measure a displacement of the piston block disposed in the hydraulic actuator; and a controller disposed in communication with each of the first pressure sensor, the displacement sensor, the first IMV, and the second IMV, wherein the controller is configured to:

determine that the displacement of the piston block within the hydraulic actuator, as measured by the displacement sensor, is indicative of a positive displacement corresponding to an expansion of the hydraulic actuator, determine that the pressure of fluid in the head end chamber as measured by the first pressure sensor decreases to a value less than an initially registered pressure of fluid in the head end chamber registered upon activation of the ride control system, determine that a deviation in the pressure of fluid in the head end chamber is within a pre-determined frequency range associated with a time period within which to attenuate oscillations in the hydraulic actuator, and responsive to the determining that the displacement of the piston block within the hydraulic actuator is indicative of the positive displacement corresponding to an expansion of the hydraulic actuator, the determining that the pressure of fluid in the head end chamber has decreased to the value less than the initially registered pressure, and the determining that the deviation in the pressure of fluid in the head end chamber is within the pre-determined frequency range, close the first IMV and open the second IMV so as to supply pressurized fluid from the variable displacement pump into the head end chamber of the hydraulic actuator.

10. The machine of claim 9, wherein the controller is configured to maintain the closed and open states of respective ones of the first IMV and the second IMV until the pressure of fluid in the head end chamber is commensurate with the displacement of the piston block within the hydraulic actuator.

11. The machine of claim 9 further comprising:

a second supply line configured to fluidly couple the secondary supply line with the rod end chamber of the hydraulic actuator, the second supply line having a third IMV disposed therein, the third IMV configured to operatively supply fluid from the variable displacement pump to the rod end chamber of the hydraulic actuator; and a second drain line configured to fluidly couple the primary supply line with the rod end chamber of the hydraulic actuator, the second drain line having a fourth IMV disposed therein, the fourth IMV configured to operatively allow fluid to return from the rod end chamber to the tank.

12. The machine of claim 11 further comprising a second pressure sensor configured to measure a pressure of fluid in the rod end chamber of the hydraulic actuator, the second pressure sensor being disposed in communication with the controller.

13. The machine of claim 12, wherein:

when the displacement of the piston block within the hydraulic actuator, as measured by the displacement sensor, is indicative of a positive displacement corresponding to an expansion of the hydraulic actuator, and when the pressure of fluid in the head end chamber as measured by the first pressure sensor is less than a pressure of fluid in the rod end chamber as measured by the second pressure sensor, then the controller is configured to open the second IMV and the third IMV so as to route fluid from the rod end chamber to the head end chamber.

14. The machine of claim 13, wherein the controller is configured to close the third IMV when the pressure of fluid in the head end chamber becomes equal to or greater than the pressure of fluid in the rod end chamber.

15. The machine of claim 13, wherein the controller is configured to close the fourth IMV when the third IMV is opened so as to prevent a flow of fluid from the rod end chamber of the hydraulic actuator to the tank via the second drain line.

16. A method for operatively attenuating oscillations in a hydraulic actuator of a machine configured to implement a ride control system, the hydraulic actuator having a chamber and a piston block disposed within the chamber to define a head end chamber and a rod end chamber with mutually opposing faces of the piston block and the chamber, the method comprising:

measuring, using a displacement sensor, a displacement of the piston block disposed in the hydraulic actuator;

measuring, using a first pressure sensor, a pressure of fluid in the head end chamber of the hydraulic actuator;

determining, using a controller communicably coupled to each of the displacement sensor and the first pressure sensor:

that the displacement of the piston block within the hydraulic actuator, as measured by the displacement sensor, is indicative of a positive displacement corresponding to an expansion of the hydraulic actuator, and that the pressure of fluid in the head end chamber is less than an initially registered pressure of fluid in the head end chamber registered upon activation of the ride control system such that a deviation in the pressure of fluid in the head end chamber is within a pre-determined frequency range associated with a time period within which to attenuate oscillations in the hydraulic actuator; and responsive to said determining, closing a first independent metering valve (IMV) so as to prevent fluid from the head end chamber from flowing back to a tank, and opening a second IMV so as to supply pressurized fluid from a variable displacement pump into the head end chamber of the hydraulic actuator.

17. The method of claim 16 further comprising maintaining the closed and open states of respective ones of the first IMV and the second IMV until the pressure of fluid in the head end chamber is commensurate with the displacement of the piston block within the hydraulic actuator.

18. The method of claim 16 further comprising measuring, using a second pressure sensor, a pressure of fluid in the rod end chamber of the hydraulic actuator, the second pressure sensor being disposed in communication with the controller.

19. The method of claim 18 further comprising opening a third IMV while the second IMV remains open so as to route fluid from the rod end chamber to the head end chamber:

when the displacement of the piston block within the hydraulic actuator, as measured by the displacement sensor, is indicative of a positive displacement corresponding to an expansion of the hydraulic actuator; and when the pressure of fluid in the head end chamber as measured by the first pressure sensor is less than a pressure of fluid in the rod end chamber as measured by the second pressure sensor.

20. The method of claim 19 further comprising:

closing the third IMV when the pressure of fluid in the head end chamber becomes equal to or greater than the pressure of fluid in the rod end chamber.

* * * * *